United States Patent [19]

Hubbard

[11] 4,421,261

[45] Dec. 20, 1983

[54] WEB FEED TRACTOR

[75] Inventor: Leo J. Hubbard, Somerset, Mass.

[73] Assignee: Precision Handling Devices, Inc., Assonet, Mass.

[21] Appl. No.: 225,586

[22] Filed: Jan. 16, 1981

[51] Int. Cl.[3] ..... B65H 17/38

[52] U.S. Cl. ..... 226/74; 226/170

[58] Field of Search ..... 226/74, 75, 87, 170, 226/171, 172, 173, 190, 194, 6

[56] References Cited

U.S. PATENT DOCUMENTS

| | | | |
|---|---|---|---|
| 3,113,823 | 12/1963 | Phillips | 226/75 X |
| 3,746,228 | 7/1973 | Arnold | 226/75 |
| 3,825,162 | 7/1974 | Hubbard | 226/74 |
| 3,908,883 | 9/1975 | Bellisai et al. | 226/74 |
| 4,079,876 | 3/1978 | Malachowski | 226/75 |
| 4,129,239 | 12/1978 | Hubbard | 226/75 |
| 4,194,660 | 3/1980 | Seitz | 226/74 |
| 4,199,091 | 4/1980 | Hubbard | 226/74 |
| 4,226,353 | 10/1980 | Blaskovic et al. | 226/74 |

*Primary Examiner*—Stanley N. Gilreath
*Attorney, Agent, or Firm*—Martin Lukacher

[57] ABSTRACT

A web feed tractor having an endless belt with drive pins which engage the perforations in a web such as computer forms which are to be driven has a frame which define concave and convex reaches of the belt. An outwardly open convex slot and a partially closed concave slot along opposite edges of the frame support and guide the belt reaches. The tips of the pins extending from the belt along the concave reach of the belt are in sliding contact with the outer wall of the partially closed slot. The tractor is compact and the concave reach of the belt which is not in driving relationship with the web is retained inside the tractor structure so that it does not interfere with other parts of the equipment in which the tractor is installed. The tractor is concavo-convex and oblong in shape or somewhat banana shaped.

10 Claims, 4 Drawing Figures

WEB FEED TRACTOR

DESCRIPTION

The present invention relates to tractors for feeding perforated webs and particularly a tractor which feeds a perforated web along a non-straight path.

The invention is especially suitable for use in printers for feeding perforated computer forms through the printer in precisely aligned relationship with the printhead. The invention permits the computer form or any other web to be driven along a convexly curved path for efficient positioning of the web and affords a tractor of compact shape conforming to the path without exterior guide or rollers for the web or for the drive belt in the tractor.

Web feed tractors and computer forms feeding tractors which are in general use have an endless belt which is driven along a straight path. Pins projecting from the belt engage perforations in the web and drive the web. Reference may be had to U.S. Pat. Nos. 3,825,162 and 4,129,239 in the name of L. J. Hubbard for further information with respect to such tractors. In some applications it is desirable that the web be fed along a non-straight path, and particularly a convexly curved path. The belt then tends to hang down in the reach opposite from the convexly curved reach which is in driving relationship with the web. While various forms of belt drives and retainment have been suggested (see U.S. Pat. Nos. 3,113,823, 3,908,883, 4,079,876 and 4,194,660) the problem remains of efficient positioning of the web thereby avoiding a hangdown, maintaining a compact shape for the belt and therefore for the tractor, and avoiding interference between the belt and other parts of the equipment in which the tractor may be installed.

Accordingly it is an object of this invention to provide an improved tractor for feeding perforated webs along a non-straight path.

It is a further object of the invention to provide an improved tractor having a driven endless belt with pins projecting therefrom, where the path of the belt which is in engagement with the web to be fed is not straight.

It is a still further object of the present invention to provide an improved tractor for feeding perforated webs which is of curved shape.

It is a still further object of the present invention to provide an improved tractor for feeding perforated webs, such as computer forms, where the driving engagement between the tractor belt and the web is along a curved path.

It is a still further object of the present invention to provide an improved tractor having concave and convex edges and which is of a concavo-convex, oblong shape.

It is a still further object of the present invention to provide an improved tractor of curved shape which is compact in size.

It is a still further object of the present invention to provide an improved tractor of curved shape in which external devices for guiding the belt along a curved path are contained entirely within the tractor itself.

It is a still further object of the present invention to provide an improved tractor which is convex and concave along opposite edges and has a belt contained therein which does not project outside the concave edge of the tractor so as to prevent interference with other devices in the equipment in which the tractor is installed.

Briefly described, a curved, banana shaped tractor provided by the invention has an endless belt having pins projecting outwardly and drive elements and inwardly thereof. A pair of juxtaposed side plates define a frame of concavo-convex, oblong shape, in some respects similar to a banana in shape. The frame and side plates are convexly curved along one surface and concavely curved along the opposite surface. An outwardly open convexly curved slot is defined by the side plates along the convexly curved surface and the pins extend from the convexly curved slot into engagement with the web which follows the convex curve as it is driven by the tractor. A concavely curved slot is defined by the side plates opposite the convexly curved surface. The inner wall of the concavely curved slot forms a convexly curved bearing surface for the tips of the pins. This bearing surface serves to guide the belt. The tractor is therefore of curved, and particularly of concavo-convex, oblong shape and is as compact as such shape will allow. There are no overhangs of the belt, nor are any parts external of the tractor necessary for the guidance and support of the belt.

The foregoing and other objects, features and advantages of the invention as well as a presently preferred embodiment thereof will become more apparent by the reading of the following description in connection with the accompanying drawings in which.

Figure 2A:
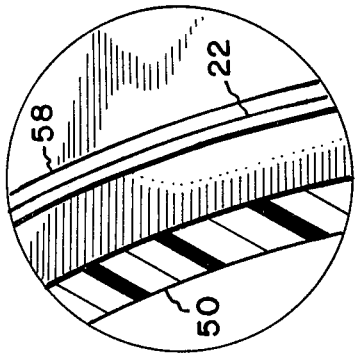
FIG. 2A is an enlargement of a portion of FIG. 2 which is enclosed within the dash circular line A in FIG. 2.

Referring more particularly to the drawings, there is shown a web feed tractor 10 which is designed to drive a web, such as a computer form, which is perforated along each edge. Two such tractors are used; one for driving the web by engaging the perforations along one edge and the other by engaging the perforations along the opposite edge of the web. The tractors are adapted to be supported by a drive shaft and a support shaft. The drive shaft extends through a square hole 12 in a drive sprocket 14, and the support shaft extends through an opening 16 in a collet clamp mechanism 18. The arrangement of a pair of tractors is shown in the above referenced Hubbard patents and the clamp mechanism is described in U.S. Pat. No. 4,129,299.

The tractor has a frame 20 of concavo-convex, oblong shape. An endless belt 22 is supported in the frame. The belt has attached thereto integral pin 24 and drive element 26 members which are spaced along the belt. The design of these pin and drive members is described more fully in the above referenced Hubbard U.S. Pat. No. 3,825,162. The drive elements engage the sprocket 14, such that the belt 22 is driven upon the rotation of the shaft in the square hole 12 in the sprocket 14. A lid or cover 28 is attached to the frame 20 and is spring biased so that it snaps from an open position to the closed position, as shown in the drawing, and is held in the open and closed position by springs 30. The cover 28 has a slot 32 into which the pins 24 partially extend when the cover is in the closed position. Bridges 34 over the slot do not extend downwardly the complete depth of the slot and strengthen the slotted cover 28. An extending tab 35 on the cover 28, which may be tilted upwardly, may be used to facilitate handling of the cover.

Figure 3:
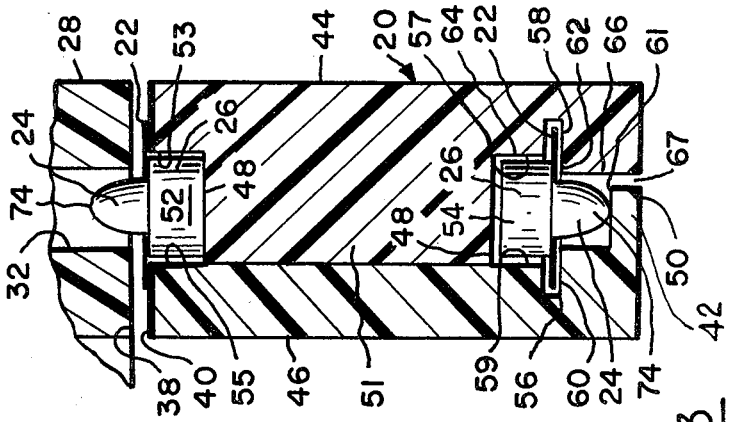
FIG. 3 is a fragmentary view taken along the line 3—3 in FIG. 1.

The cover 28 and the frame 20 are both curved. The web is fed along a curved path between the concavely curved inner surface 38 of the cover and convexly curved outer surface 40 of the frame 20. The surface 42 of the frame 20, shown at the bottom in FIG. 3, is also concavely curved.

Figure 2:
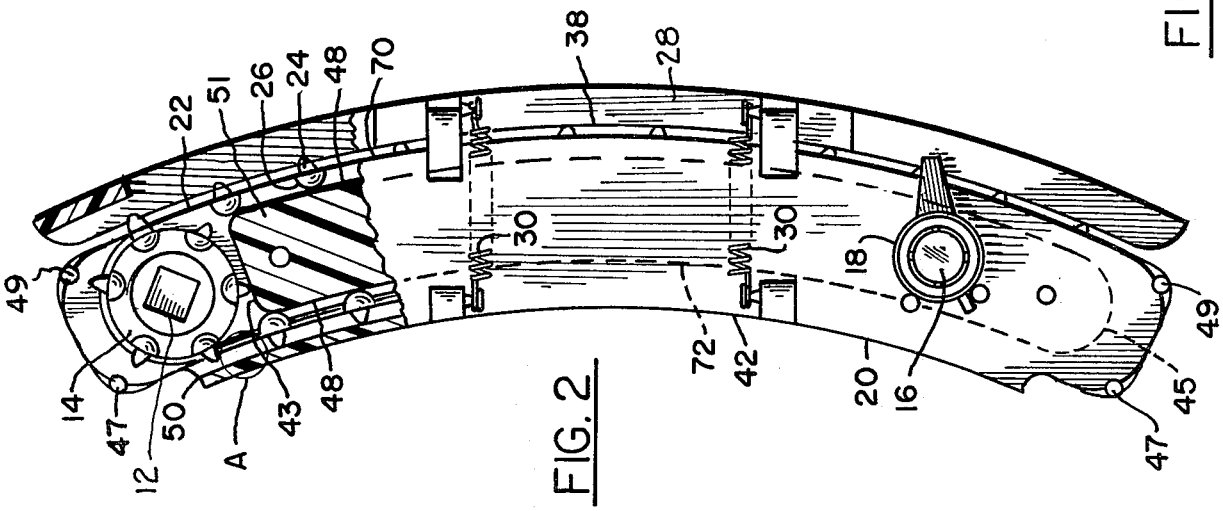
FIG. 2 is a side view of the tractor, which is partially in section, the section being taken along the line 2—2 in FIG. 1.
Figure 1:
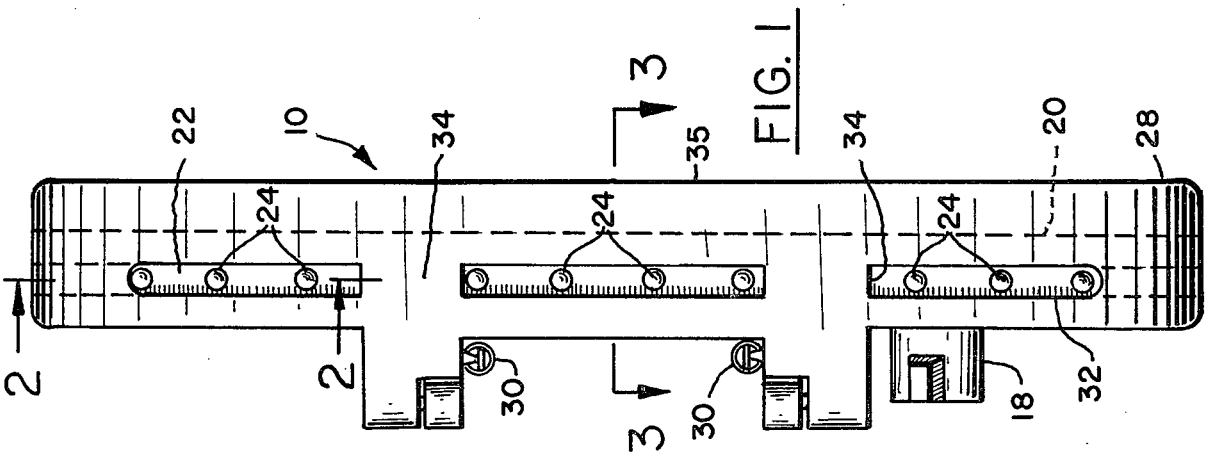
FIG. 1 is a top view of a tractor provided in accordance with the invention.

The guidance and support of the belt 22, so as to enable the belt to be maintained within the confines of the frame in a compact configuration and without placing an undue and excessive drag on the belt which might overload the tractor drive, is an important feature of the invention. This is accomplished through the use of the frame 20 made up of side plate members 44 and 46. These side plates are juxtaposed and held together by screws or other fastening means (not shown). Pins 47 and 49, which may be molded integrally with the left side plate 46 extend laterally and engage the inside wall of the right side plate 44 to assist in assembly and maintaining the spacing of the ends of the side plates. The pins 49 also assist in guiding and stripping the web. The side plate 44 shown on the right in FIG. 3, is formed with a spacer and guide member 51 having a ledge 48 which extends toward the other side plate 46. The right side of the ledge 48, as viewed in FIG. 2, is convexly curved and is parallel to the convexly curved surface 40 of the frame 20. The left side of the ledge 48 is concavely curved and is parallel to the concavely curved lower surface 42 of the frame 20. One of the ends 43 of the ledge 48 clears the sprocket 14 and the other end 45, which is opposite therefrom, is semicircular. The sprocket 14 and semicircular end 45 change the direction of the belt 22 between the upper and lower reaches 70 and 72, thereof. The semicircular end 45 may be in the form of a shoe, movably mounted in slots in the frame 20 and spring biased outwardly to tension the belt 22. The left side plate 46 has a lip 50 along the concave edge 42 of the frame. The convexly curved portion of the ledge 48, and the opposing interior walls 53 and 55 of the side plates 44 and 46 form a convexly curved slot 52 along the convex frame surface 40. A concavely curved slot 54 is formed by the concavely curved, right side of the ledge and opposing interior walls 57 and 59 of the side plates 44 and 46, along the concave surface 42. Guidance of the upper reach 70 of the belt 22 to locate it in the direction of the web (vertically in FIG. 2) and laterally in the region of the web is thereby provided, as described in Hubbard, U.S. Pat. No. 3,825,162.

The concavely curved slot 54 is provided with notches 56 and 58 in which the belt 22 is disposed. The side walls 57 and 59 of the right side plate 44 and the left side plate 46 have steps 60 and 62 which, in part, define inner and outer portions 64 and 66 of the slot 54. The lip 50 is narrower than the width of the outer slot portion 66 and provides a clearance 67, through which paper dust and other debris can leave the tractor. The drive elements 26 are in the wider slot portions 64 and the pins 24 are in the narrower slot portions 66.

The concavely curved slot 54 defines the path of the lower, convexly curved reach 72 of the belt 22. Support and guidance of the belt in the convexly curved reach 72 is provided by sliding contact of the tips 74 of the pins 24 with the interior wall 61 of the slot 54 which is formed by the lip 50.

Because of the dimensions of the slot 54, there is clearance between the belt and the walls of the notches 56 and 58 and between the drive elements and the ledge 48 in the convexly curved reach 72 of the belt 22 which is located in the slot 54. Accordingly, minimum frictional drag is placed on the belt while the belt is guided and supported in the convexly curved reach 72. All of the parts of the tractor except for the screws and fasteners and the spring may be fabricated from plastic material such that it may be light in weight and low in cost.

From the foregoing description it will be apparent that there has been provided an improved tractor for feeding perforated webs, such as computer forms, along non-straight paths. Variations and modifications of the herein described embodiment, within the scope of the invention, will undoubtedly suggest themselves to those skilled in the art. Accordingly, the foregoing description should be taken as illustrative and not in a limiting sense.

I claim:

1. A tractor for feeding perforated webs comprising an endless belt having pins projecting outwardly and drive elements projecting inwardly thereof, a frame of concavo-convex, oblong shape having a pair of juxtaposed side plates, said frame being convexly curved and concavely curved along opposite surfaces thereof, an outwardly open, convexly curved slot defined by said side plates along said convexly curved surface, a concavely curved slot defined by said side plates along said concavely curved surface, said concavely curved slot being at least partially closed, at least one sprocket journalled in said side plates, said belt being disposed between said side plates and around said sprocket with a plurality of said drive elements engaged with said sprocket and with one reach of said belt in said convexly curved slot and guided thereby along a convexly curved path, and the reach of said belt opposite to said one reach being disposed within said concavely curved slot and guided therein along a concavely curved path.

2. The invention as set forth in claim 1 wherein said concavely curved slot has a wall paralleling said opposite reach of said belt, said paralleling wall of said concavely curved slot being adjacent to said pins and the tips of a plurality of said pins being in contact with said paralleling wall.

3. The invention as set forth in claim 2 wherein said one reach of said belt has said pins projecting outwardly from the concavely curved surface of said frame into driving relationship with said web perforations.

4. The invention as set forth in claim 1 wherein said convexly curved slot has a wall spaced inwardly from said convexly curved surface and extending along said one reach of said belt, said drive elements on said belt outer reach being disposed in sliding contact with said inner wall.

5. The invention as set forth in claim 1 wherein said inwardly spaced wall of said convexly curved slot is provided by a member having a ledge, said member being connected to at least one of said side plates.

6. The invention as set forth in claim 1 wherein one of side plates has a lip thereon which defines the concavely curved surface of said frame, the inside of said lip defining an outer wall of said concavely curved slot which extends along said concavely curved opposite reach of said belt, the tips of said pins and said outer wall of said concavely curved slot being in sliding contact.

7. The invention as set forth in claim 6 wherein said concavely curved slot has an inner wall spaced inwardly of said outer wall, the distance between said inner and outer walls of said concavely curved slot being less than the distance between the tips of said drive element and pins such that the concavely curved reach of said belt is supported between said inner and outer walls.

8. The invention as set forth in claim 6 wherein the width of said belt is greater than the width of said driving elements, said concavely curved slot having side walls between said inner and outer walls, said side walls having opposing notches therein, said belt having said opposite edges disposed in said notches.

9. The invention as set forth in claim 1 wherein the first of said pair of side plates has a ledge with opposite sides disposed along said one reach and said opposite reach of said belt, said ledge being semicircular near one end of said first side plate to define a guide for one end of said belt which turns said belt between said one and said opposite reaches thereof, said sprocket being disposed near the end of said first side plate opposite to said one end, said belt being turned around said sprocket between said one and said opposite reaches thereof, the second of said pair of side plates being disposed adjacent to said ledge to define said convexly and concavely curved slots, said second plate having a lip defining said concave surface of said frame and spaced from the side of said ledge which is disposed along said opposite reach of said belt, said lip being disposed across said concavely curved slot and defining a bearing surface for the tips of said pins along said opposite reach of said belt.

10. The invention as set forth in claim 3 further comprising cover pivotally mounted on said frame and moveable to a position spaced from said convexly curved edge of said frame to provide a clearance through which said web is driven by said belt.

* * * * *